US006042077A

United States Patent [19]

Shoesmith

[11] Patent Number: 6,042,077

[45] Date of Patent: Mar. 28, 2000

[54] TREE STAND AND METHOD

[76] Inventor: Gary L. Shoesmith, 5188 Clearview Dr., Winston-Salem, N.C. 27104

[21] Appl. No.: 08/905,320

[22] Filed: Aug. 4, 1997

Related U.S. Application Data

[63] Continuation of application No. 08/590,888, Jan. 24, 1996, abandoned.

[51] Int. Cl.[7] ..... F16M 13/00

[52] U.S. Cl. ..... 248/523; 248/188.5

[58] Field of Search ..... 248/523, 519, 248/436, 188.2, 188.5, 188.8, 524, 525; 47/40.5

[56] References Cited

U.S. PATENT DOCUMENTS

| | | | |
|---|---|---|---|
| 2,652,217 | 9/1953 | Schulz | 47/40.5 |
| 2,815,908 | 12/1957 | Scanland | 47/40.5 |
| 3,142,464 | 7/1964 | Zelenitz | 248/523 |
| 3,350,043 | 10/1967 | Apple | 248/523 |
| 3,591,114 | 7/1971 | Beatty | 47/40.5 |
| 3,863,876 | 2/1975 | Finkelstein et al. | 248/188.7 |
| 4,190,983 | 3/1980 | Rostomily | 47/40.5 |
| 4,750,702 | 6/1988 | Neil et al. | 248/523 |
| 4,978,098 | 12/1990 | Peckinpaugh | 248/523 |
| 5,002,252 | 3/1991 | Setala et al. | 248/533 |
| 5,209,450 | 5/1993 | Grapes | 249/523 |
| 5,318,267 | 6/1994 | Rast | 248/523 |
| 5,522,642 | 6/1996 | Herzog | 297/344.18 |

FOREIGN PATENT DOCUMENTS

| | | | |
|---|---|---|---|
| 822469 | of 1937 | France | 47/40.5 |
| 545486 | of 1942 | United Kingdom | 47/40.5 |
| 932432 | of 1963 | United Kingdom | 47/40.5 |

*Primary Examiner*—Ramon O. Ramirez

[57] ABSTRACT

A tree stand provides ease and convenience for correct vertical alignment of the tree trunk by utilizing telescoping legs which are freely slidable when unlocked. The tree trunk can be positioned in the stand and secured by threaded members which tighten against the trunk. By removing the locking pins from the legs and tilting the tree to the desired vertical position, the inner slidable members slide to the floor below. By reinserting the pins, the tree remains in correct alignment. One or two persons can easily align a tree without the need of tools or special equipment.

7 Claims, 4 Drawing Sheets

TREE STAND AND METHOD

This is a continuation of application Ser. No. 08/590,888, filed Jan. 24, 1996, now abandoned.

BACKGROUND OF THE INVENTION

1. Field of the Invention

The invention herein relates to portable tree stands for ornamental trees such as Christmas trees and includes telescoping legs which can be unlocked to become freely slidable to assist in the correct vertical alignment of the tree. An individual can easily adjust the verticality of a tree without the assistance of others by simple rotational movement of the stand and locking pin manipulation.

2. Description of the Prior Art and Objectives of the Invention

Portable tree stands have been widely used for many years to support Christmas trees and other types of synthetic and natural trees, generally for indoor use. Conventional tree stands are usually adjustable to accommodate small diameter tree trunks which may vary from one to six inches for trees having an approximate height of from four to ten feet. Such stands also are provided with a pan or liquid container to supply the tree with water to prolong its life. While most commercially sold tree stands will hold a tree securely, many do not provide a way to easily align or straighten the tree once it is affixed in the stand, thus causing the user to unloosen or remove the tree from the stand and once again set the tree to a more desirable posture. Many times a tree of usual height (6–8 feet) will require two people to place the tree in a stand and correctly align it along its vertical axis. Also, many standard tree stands must be shimmed or have the tree tethered to a wall in order to establish a straight vertical tree posture.

Thus, with the disadvantages and shortcomings of conventional tree stands, the present invention was conceived and one of its objectives is to provide a tree stand which is portable, relatively light in weight and which can be easily operated by a single individual.

It is another objective of the invention to provide a tree stand which has arcuate telescoping legs which move with a vertical component to easily correct vertical tree misalignment.

It is a further objective of the invention to provide a tree stand in which the inner slidable leg members are visible only to the extent required for straightening the tree.

It is yet another objective of the present invention to provide a tree stand having a plurality of legs which are telescopically slidable when unlocked.

It is still another objective of the present invention to provide a tree stand which can be used by those with little or no experience in setting a tree without undue thought or effort.

Various other objectives and advantages of the present invention will become apparent to those skilled in the art as a more detailed disclosure is set forth below.

SUMMARY OF THE INVENTION

The aforesaid and other objectives and advantages are realized by a tree stand having a plurality of tubular legs which telescope in a vertical direction. Threaded horizontal members mounted in an annular ring are tightenable against the tree trunk to hold the tree within the stand. Each leg includes an outer sleeve and a slidable inner member which may both be circular, square, semi-circular or have other configurations. The inner member is freely slidable when unlocked, i.e., will slide due to the influence of gravity because of its downward angle, loose fit and weight. A locking pin maintains the telescoping leg at the correct selected extension to insure and maintain the desired vertical alignment of the tree.

The method of using the invention usually by one person consists of placing the tree trunk (trimmed of any interfering branches) in the annular ring with the tree on its side and tightening each of the threaded horizontal securing members against the tree trunk. Next, the tree and stand are lifted to a standing position. The locking pins are then removed, and the tree is then pivoted to the desired vertical alignment, while lifting one or more of the legs from the floor. The inner slidable members of the telescoping legs which are raised will slide under the influence of gravity to the floor. As the tree is released, a binding effect will take place between the inner slidable members and the outer sleeves of the legs, holding the tree in the desired position. The locking pins are then replaced to secure the tree in the vertical position selected. If the tree, when viewed, remains in an incorrect vertical alignment, the process can be repeated until the tree is straight or at a desired angle.

If two people are available, the steps above can be utilized except the locking pins are left in place in the legs as the tree and stand are pivoted to the desired vertical position suspending one or more legs above the floor. At that point the locking pins are removed, allowing the inner slidable members of the lifted legs to extend to the floor. Thereafter, the locking pins are replaced with the tree fully straightened.

DESCRIPTION OF THE PREFERRED EMBODIMENT

The preferred form of the invention is shown in FIGS. 1, 2, 3A, 3B, 5A and 5B whereby the tree stand includes four metal tubular telescoping legs, each having a rectangular cross section and having an approximate 45° vertical component. As seen therein, the tree stand includes a series of horizontal threaded securing members within an annular ring which are tightenable against the tree trunk and each of the four (4) telescoping legs are affixed to the annular ring which supports the horizontal securing members. Also affixed to the legs is a liquid container for supplying moisture to the terminal or bottom end of the tree trunk as is usual in the art. Each leg is vertically disposed at an approximate 45° angle and includes an aperture in the outer sleeve. The inner slidable member has a plurality of apertures for alignment with the aperture in the outer sleeve at different extension lengths of the inner slidable members within the outer sleeve. The apertures retain a locking pin which passes through the outer sleeve and into a selected coincidally aligned aperture within the inner slidable member. The inner slidable member is freely slidable, i.e., it will readily slide from within the outer sleeve by the force of gravity towards the floor when the locking pin is removed due to its 45° vertical component.

The preferred method of using the invention by one person includes tightening the trunk of a tree to the stand by the horizontal threaded members with the tree on its side. Next, the tree and stand are brought to a standing position in the desired location. The locking pins are then removed from the legs. The slidable inner leg members drop or extend to the floor as the tree and stand are manually pivoted to the desired vertical orientation. The tree is then released and a binding effect between the inner slidable members and the outer sleeves of the extended legs takes place, holding the legs in the extended position. The pins do not have to be replaced before the tree trunk is released as the weight of the tree and outer sleeves rest on the inner slidable members and "binds" the inner slidable members allowing the tree to remain upright. The binding effect is partly facilitated by the transfer of the weight of the tree by the outer sleeves to the inner slidable members that extend outwardly in a vertical and horizontal direction. The binding effect is also partly facilitated by frictionproducing rubber "shoes" at the ends of the inner slidable members, which prevents the ends of the inner slidable member from sliding along the floor. The locking pins are then replaced to maintain the selected verticality. This method provides a quick and easy remedy to an old problem of obtaining proper vertical direction of a tree and the extended inner slidable members are only visible to the extent necessary to straighten the tree.

DETAILED DESCRIPTION OF THE DRAWINGS AND OPERATION OF THE INVENTION

Figure 1:
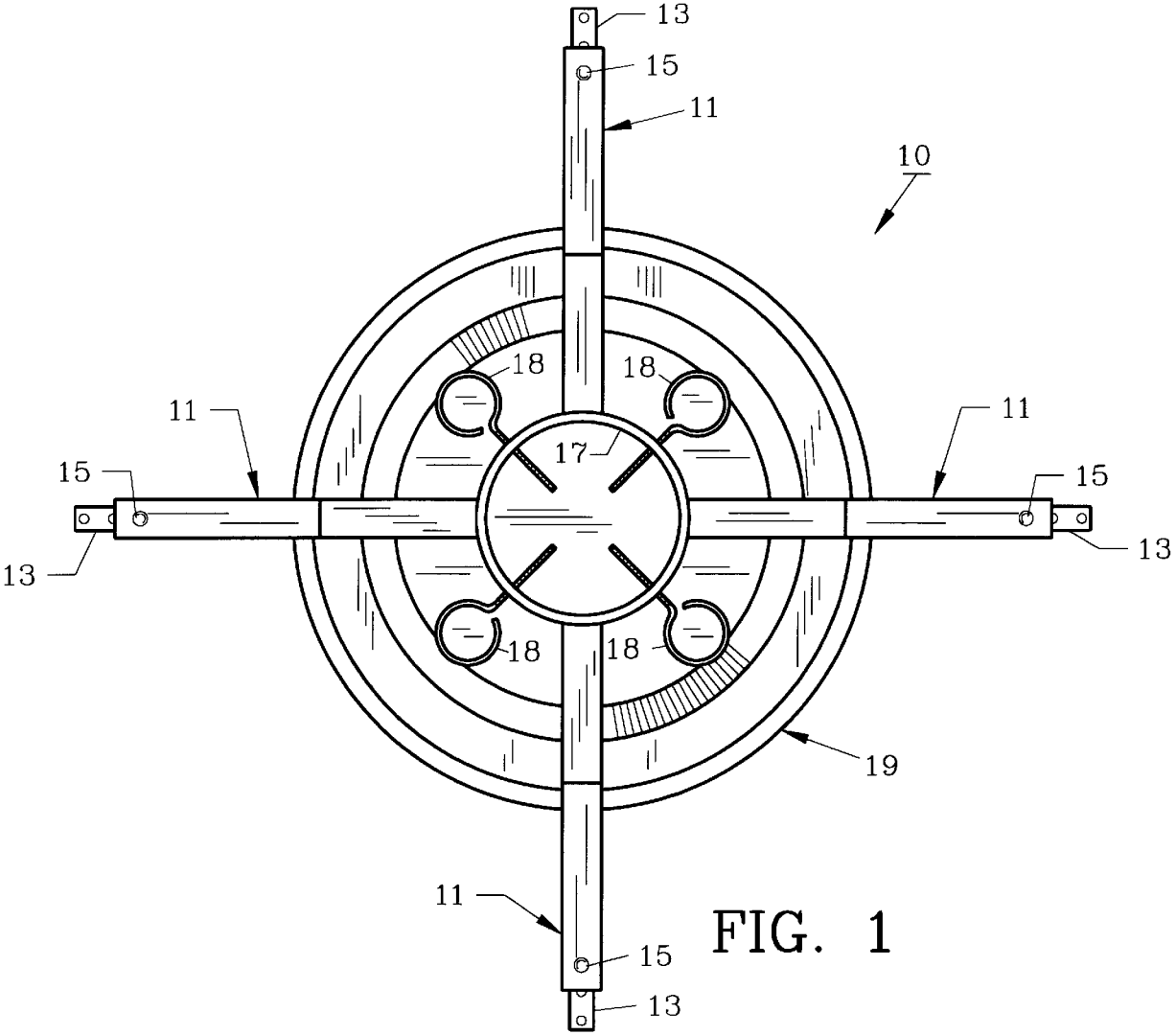
FIG. 1 shows a top view of the preferred form of the tree stand of the invention without a tree.
Figure 2:
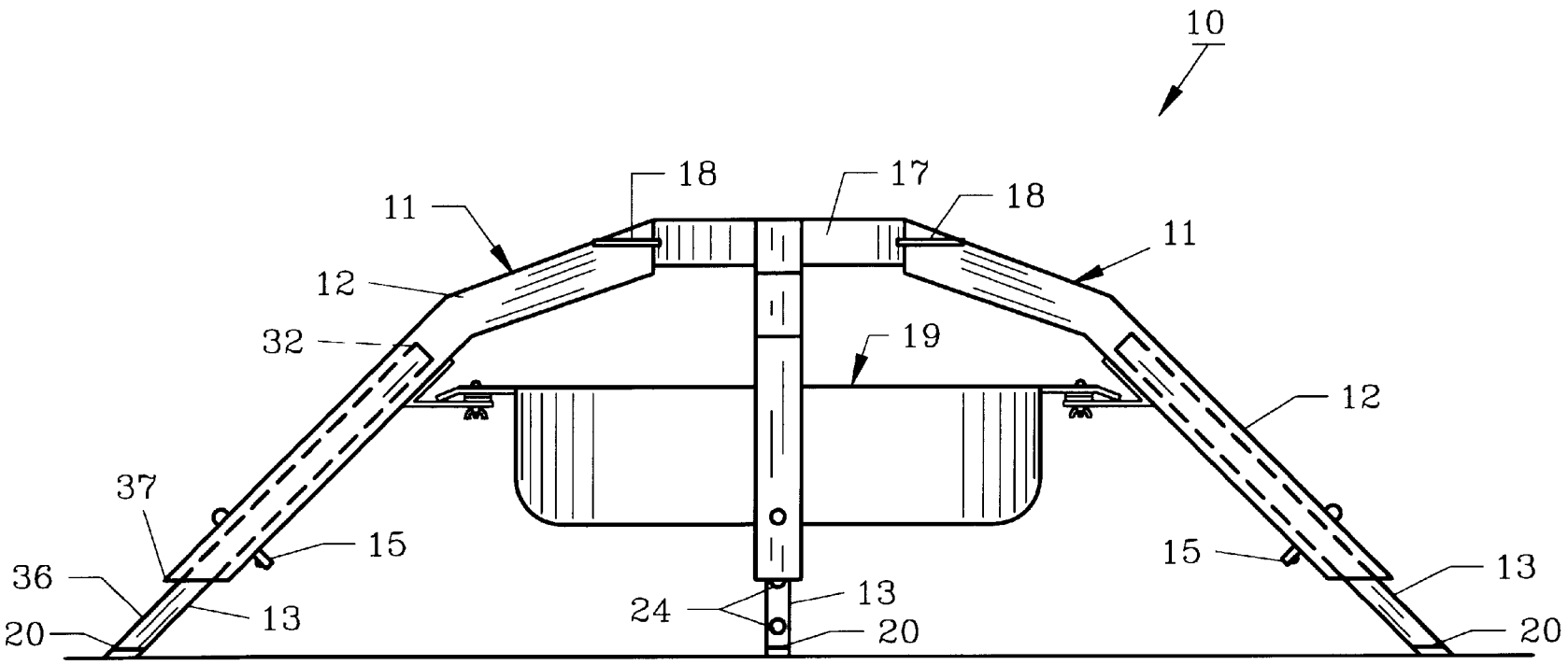
FIG. 2 monstrates a side view of the tree stand as seen in FIG. 1.
Figure 3A:
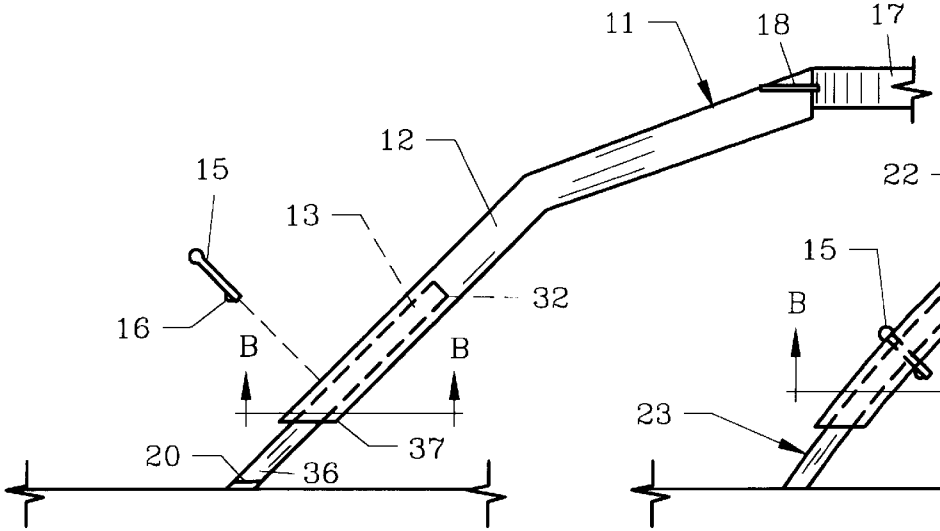
FIG. 3A depicts a view of the preferred embodiment of one of the telescoping legs.
Figure 3B:
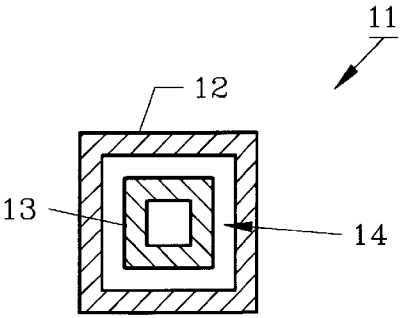
FIG. 3B illustrates a cross-sectional view of the leg as shown in FIG. 3A along lines B—B.

Turning now to the drawings, the preferred form of the invention as shown in FIGS. 1 and 2 illustrates tree stand 10 which includes four telescoping legs 11 formed from square steel tubing as shown in FIG. 3B. Telescoping leg 11 includes an outer sleeve 12 and an inner slidable member 13 having a friction-producing shoe 20 thereon, as seen in FIG. 2. Outer sleeve 12 has distal end 37 while inner member 13 has proximate end 32 and distal end 36 with shoe 20 disposed thereon. Although the tree stand 10 is shown with four telescoping legs, other combinations are contemplated as part of the present invention such as two non-telescoping legs with one or more telescoping legs, one non-telescoping leg with two or more telescoping legs, or the like. Conventional locking pin 15 includes a spring-loaded sphere 16 which locks pin 15 in place. Tree stand 10 includes annular ring 17 through which four threaded adjustable members 18 act to adjustably secure tree trunk 31 therein.

Figure 4A:
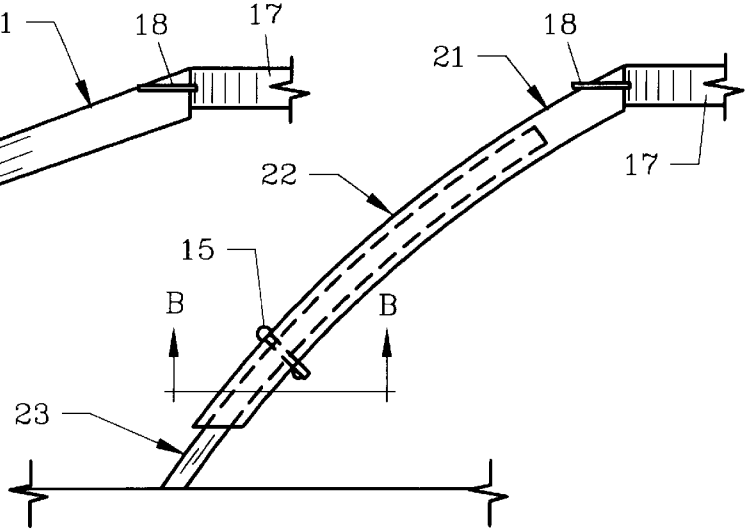
FIG. 4A depicts an alternate embodiment of a telescoping leg.
Figure 4B:
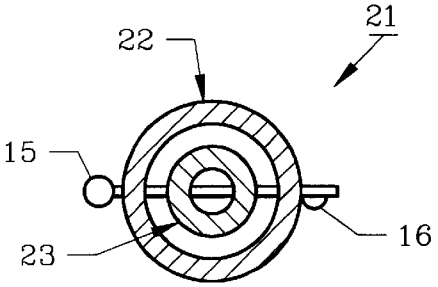
FIG. 4B features a cross-sectional view of the leg as shown in FIG. 4A along lines B—B.

In another embodiment of the invention as shown in fragmented fashion in FIGS. 4A and 4B, leg 21 has a smooth arcuate shape as opposed to the "kinked" shape of leg 12 to minimize the footprint of stand 10 when inner slidable members 13 are extended. Telescoping leg 21 includes an outer sleeve member 22 and an inner slidable member 23. In FIG. 4B, leg 21 is shown with a round tubular shape as seen along lines B—B of FIG. 4A. Although the embodiment illustrated uses pins 15 within apertures in the outer sleeves 12 and apertures in the inner slidable members 13 to lock the inner slidable members 13 to the outer sleeves, other locking mechanisms are contemplated as part of the present invention. For example, the inner slidable member 13 can be locked in position within the outer sleeve 12 by a cam and lever arrangement that secures the inner slidable member 13 to the outer sleeve 12 with a frictional hold, or the like.

Figure 5B:
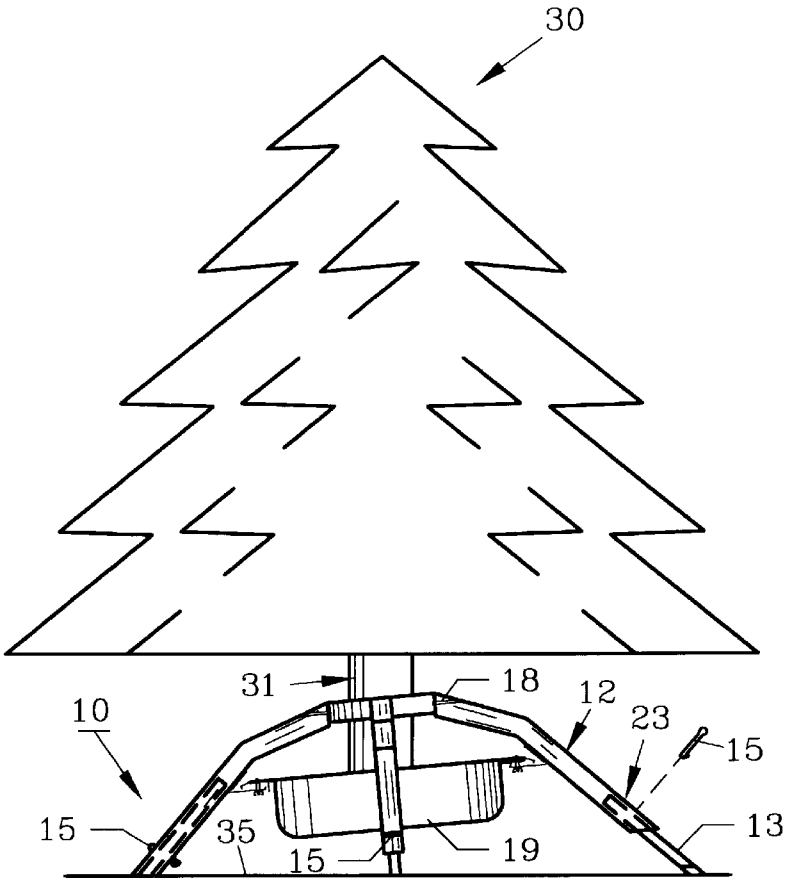
FIG. 5B shows the stand of FIG. 5A pivoted approximately 10° with the telescoping legs extended to the floor to maintain the correct vertical posture of the tree.
Figure 5A:
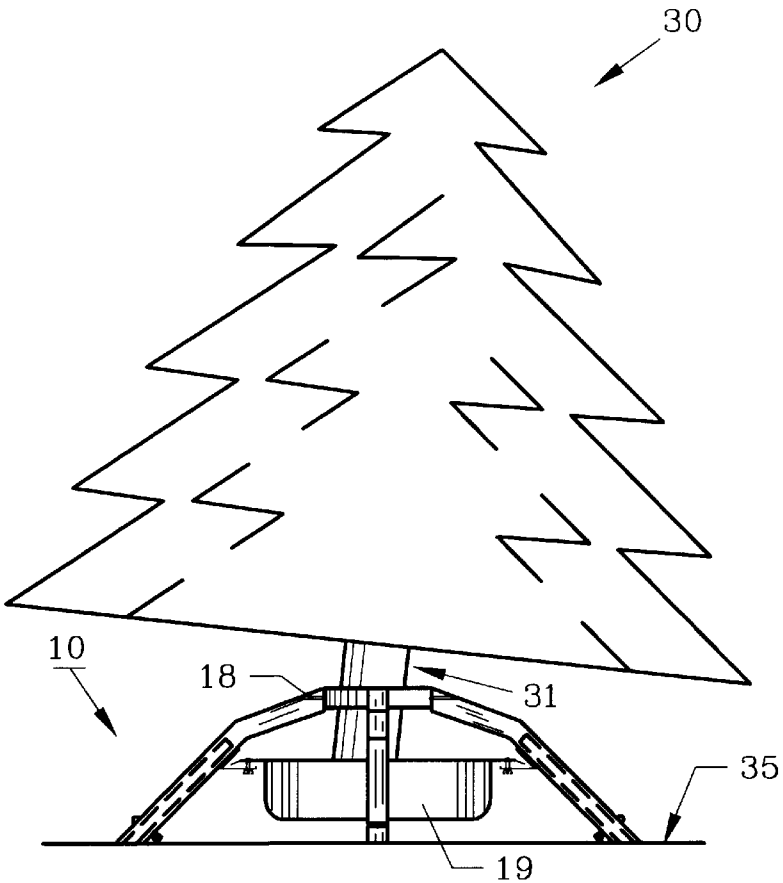
FIG. 5A illustrates a typical Christmas tree as incorrectly positioned in the tree stand as seen in FIG. 1.

In FIG. 5A, tree stand 10 is depicted with evergreen tree 30 positioned therein at an angle to the vertical (exaggerated for clarity) as may be used for a Christmas tree. As seen, tree 30 is leaning at an approximate 10° angle from the vertical. In order to straighten tree 30, locking pins 15 are removed and trunk 31 can be grasped by hand and pulled to an upright position with certain of legs 11 being elevated from the floor. Inner slidable members 13 of the lifted legs 11 slide outwardly from the outer sleeve 12 and contact floor 35. Trunk 31 can then be released whereby outer sleeves 12 will bind against extended inner slidable members 13 due to the forces exerted by the weight of tree 30. Then, the user can replace locking pins 15 by inserting them through apertures 23 in outer sleeves 12 which coincidentally align with one of a plurality of apertures 24 within slidable members 13. With pins 15 replaced, telescoping legs 12 are locked at the extended position to insure the correct verticality of tree 30. Rubber shoes 20 inhibit the sliding of the legs 11 along the floor 35 during and after adjustment of the legs 11. Thus, tree 30 can be correctly aligned by one person, for example, without the need of assistance, even when relatively large trees are utilized.

The illustrations and examples provided herein are for explanatory purposes and are not intended to limit the scope of the appended claims.

I claim:

1. A tree stand for easily positioning and maintaining a tree trunk in a desired upright posture comprising:

a) an annular ring;

b) a liquid container spaced from said annular ring;

c) a plurality of vertically adjustable outwardly arcuate telescoping legs, each of said telescoping legs being affixed to said liquid container and having a proximate end affixed to said annular ring;

said legs each comprising:

an outer sleeve and an inner member, said inner member spaced from said outer sleeve sufficiently to allow one of the outer sleeve and inner member to freely slide relative to the other while the weight of the tree is removed therefrom and to bind to each other when the weight of the tree is applied thereto; and d) means to lock said telescoping legs, said telescoping leg locking means comprising an aperture defined in said outer sleeve, a plurality of apertures defined in said inner slidable member, and a pin, said pin for selectively positioning within coincidentally aligned apertures of said outer sleeves and one of said apertures of said inner slidable members to lock said legs at a desired height.

2. A method for an individual to mount a tree trunk in a vertical, upright posture using a stand, said stand including a plurality of freely slidable, telescoping legs each having an outer outwardly arcuate sleeve, having a distal end, and an inner member, having a proximate end, and a liquid container mounted between said legs, said method comprising the steps of:

a) affixing the stand to the bottom of the tree trunk;

b) standing the tree trunk upright;

c) pulling the tree into a vertical upright position while lifting one or more of the plurality of legs from the floor, thereby allowing the freely slidable, telescoping legs to extend; and d) thereafter binding the extended legs in a fixed position by allowing the inner member to engage the outer sleeve so that the tree freely stands.

3. The method as claimed in claim 2 further comprising the step of releasing a means for locking the telescoping legs in position.

4. The method as claimed in claim 3 further comprising the step of locking the telescoping legs into said fixed position.

5. The method as claimed in claim 4 and further comprising the step of initially placing the tree trunk on its side.

6. The method as claimed in claim 5 wherein the step of affixing the stand to the bottom of the tree trunk includes sliding the tree trunk into an annular ring; wherein allowing the inner member to engage the outer sleeve further comprises allowing the distal end of the outer sleeve to engage the inner member; wherein allowing the inner member to engage the outer sleeve further comprises allowing the proximate end of the inner member to engage the outer sleeve; further comprising the step of terminating the movement of said freely slidable legs by allowing the distal end of the freely slidable leg to frictionally engage a surface.

7. The method as claimed in claim 2 wherein affixing the stand to the bottom of the tree trunk further comprises using a threaded member to attach the stand to the tree trunk.

* * * * *